US006728500B2

(12) United States Patent
Naito et al.

(10) Patent No.: US 6,728,500 B2
(45) Date of Patent: Apr. 27, 2004

(54) PROCESS CARTRIDGE ATTACHABLE TO RECORDING APPARATUS AND RECORDING APPARATUS

(75) Inventors: Takashi Naito, Tokyo (JP); Takaaki Maekawa, Tokyo (JP); Junpei Kohara, Tokyo (JP)

(73) Assignee: Panasonic Communications Co., Ltd., Fukuoka (JP)

( * ) Notice: Subject to any disclaimer, the term of this patent is extended or adjusted under 35 U.S.C. 154(b) by 0 days.

(21) Appl. No.: 10/224,320

(22) Filed: Aug. 21, 2002

(65) Prior Publication Data

US 2003/0039484 A1 Feb. 27, 2003

(30) Foreign Application Priority Data

Aug. 23, 2001 (JP) ..... 2001-253406

(51) Int. Cl.[7] ..... G03G 15/08
(52) U.S. Cl. ..... 399/113; 399/119
(58) Field of Search ..... 399/27, 113, 359, 399/119

(56) References Cited

U.S. PATENT DOCUMENTS

| | | | | |
|---|---|---|---|---|
| 5,537,187 A | * | 7/1996 | Sekine | 399/111 |
| 6,246,854 B1 | | 6/2001 | Kurosawa et al. | 399/263 |
| 6,377,765 B1 | * | 4/2002 | Shishido et al. | 399/113 |
| 6,526,243 B2 | * | 2/2003 | Kim et al. | 399/119 |

* cited by examiner

*Primary Examiner*—Quana M. Grainger
(74) *Attorney, Agent, or Firm*—Greenblum & Bernstein, P.L.C.

(57) ABSTRACT

The present invention provides a process cartridge includes a first unit and a second unit separable (detachable) from the first unit. The first unit includes a photosensitive member, a developing unit that forms an image on the photosensitive member, and a cleaning unit that collects residual toner from the photosensitive member. The second unit includes a toner hopper unit that supplies toner on the photosensitive member, and a waste toner box that stores the collected residual toner. The developing unit engages with the toner hopper unit so as to engage the first unit with the second unit.

21 Claims, 11 Drawing Sheets

PROCESS CARTRIDGE ATTACHABLE TO RECORDING APPARATUS AND RECORDING APPARATUS

BACKGROUND OF THE INVENTION

1. Field of the Invention

The invention relates to a process cartridge and a recording apparatus. The process cartridge is structured from multiple removable components and contains a photosensitive drum, developing unit, and other parts that relate to the development process.

2. Description of Related Art

A conventional process cartridge of the type noted above incorporates an photosensitive drum, developing unit, charger, toner hopper, cleaning unit, waste toner box, and other components used in the image development process, in the cartridge.

The components contained in the process cartridge do not have a uniform service life. That is, some of the components have a relatively long service life, and some have a short one. In regard to the type of process cartridge that can be replenished with toner, the service life of the entire cartridge is only as long as that of the component with the shortest service life. Furthermore, as expensive and inexpensive components must all be replaced together with the installation of a new cartridge, the expense of replacing the cartridge increases the cost of operating the photocopier.

One attempt to reduce the process cartridge replacement expense has been to divide the cartridge into two sub-assemblies in which the first sub-assembly consists of the photosensitive drum, charger, cleaning unit, and waste toner box, and the second sub-assembly consists of the developing unit and toner hopper. With this type of structure, only the second sub-assembly is replaced when the toner in the hopper has been depleted. As the service life of the developing unit is generally shorter than that of the photosensitive drum, only the second sub-assembly, which includes the developing unit, is replaced when a refill is required, thus reducing the toner refill expense.

The structure discussed above, however, has some inherent shortcomings which are explained below.

A photoelectric copying process using the jumping development method generates a larger amount of waste toner than the standard development method. As a result, the service life of the first sub-assembly that contains the waste toner box can be shortened to a period of time equivalent to the service life of the second sub-assembly, thus necessitating replacement of the first sub-assembly while the photosensitive drum contained therein remains usable.

To solve this problem, it has been proposed that the waste toner box be structured as a separate component that essentially becomes a third sub-assembly. Structuring the process cartridge in this manner avoids replacing the first sub-assembly while the photosensitive drum is still usable, and thus reduces the expense of operating the photocopier.

If the process cartridge is designed to be disassembled into a greater number of separate components, however, the number of replaceable components increases as well as the frequency of component replacement. The problem with this design is that it diminishes the convenience and ease with which the process cartridge, which contains various image processing components, can be replaced.

In the process cartridge structure delineated above, the developing unit and toner hopper are contained in the second sub-assembly, so both components must be replaced concurrently despite the fact that the developing unit is a more expensive component than the toner hopper.

SUMMARY OF THE INVENTION

The present invention, when applied to a recording apparatus that may even employ the jumping development method which generates a large amount of waste toner, offers the benefits of an easy process cartridge replacement procedure and reduced replacement cost.

The present invention puts forth the following mechanisms and structures to rectify the problems discussed above.

The present invention provides a process cartridge includes a first unit and a second unit separable from the first unit. The first unit includes a photosensitive member, a developing unit that forms an image on the photosensitive member, and a cleaning unit that collects residual toner from the photosensitive member. The second unit includes a toner hopper unit that supplies toner on the photosensitive member, and a waste toner box that stores the collected residual toner. The developing unit engages with the toner hopper unit so as to engage the first unit with the second unit.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein.

DETAILED DESCRIPTION OF PREFERRED EMBODIMENTS

The embodiments of the present invention are explained in the following, in reference to the above-described drawings.

Figure 1:
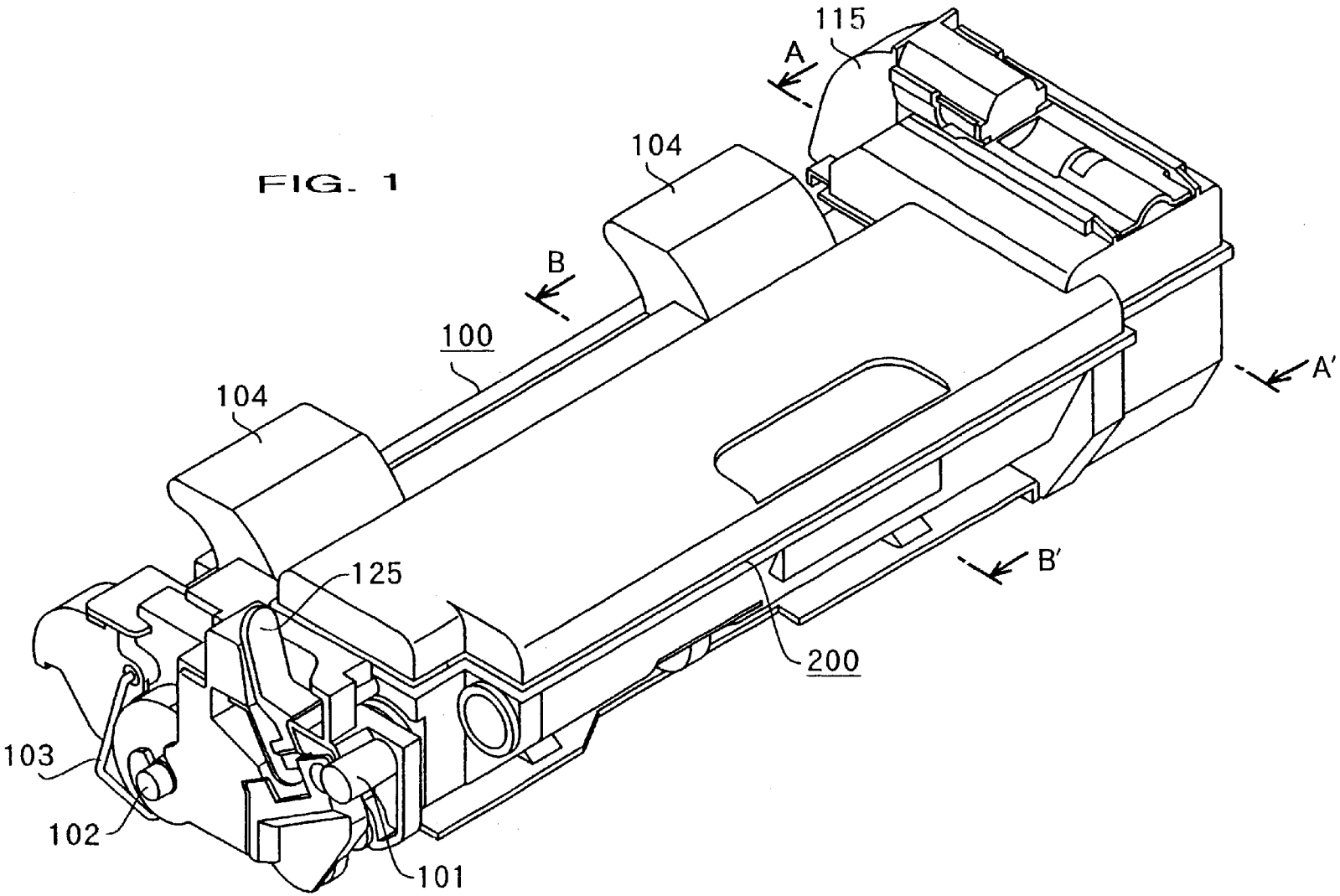
FIG. 1 is a perspective view of an embodiment of the photocopier process cartridge proposed by the invention.

FIG. 1 provides a complete perspective view of an embodiment of the process cartridge. In this embodiment, the cartridge, which is structured from mutually separable first and second sub-assemblies 100 and 200, is designed for use in the photocopying unit of a photocopying machine employing an electronic photocopying system. In order to install the process cartridge to the photocopying unit, a process cartridge installation space is provided in the photocopying unit formed to a shape that accommodates the shape of the process cartridge. Guide pins 101 and 102 are provided on the side walls of the process cartridge as means of guiding the process cartridge into the process cartridge installation space. The photosensitive drum is covered by a shutter before the cartridge is installed within the process cartridge installation space of the photocopying unit, and then the photosensitive drum is uncovered through the operation of a shutter mechanism at the time the cartridge is installed. Shutter arm 103 opens or closes the shutter mechanism when the cartridge is installed or removed. A pair of hand grips 104 are provided on the rear surface of the first sub-assembly 100.

Figure 2:
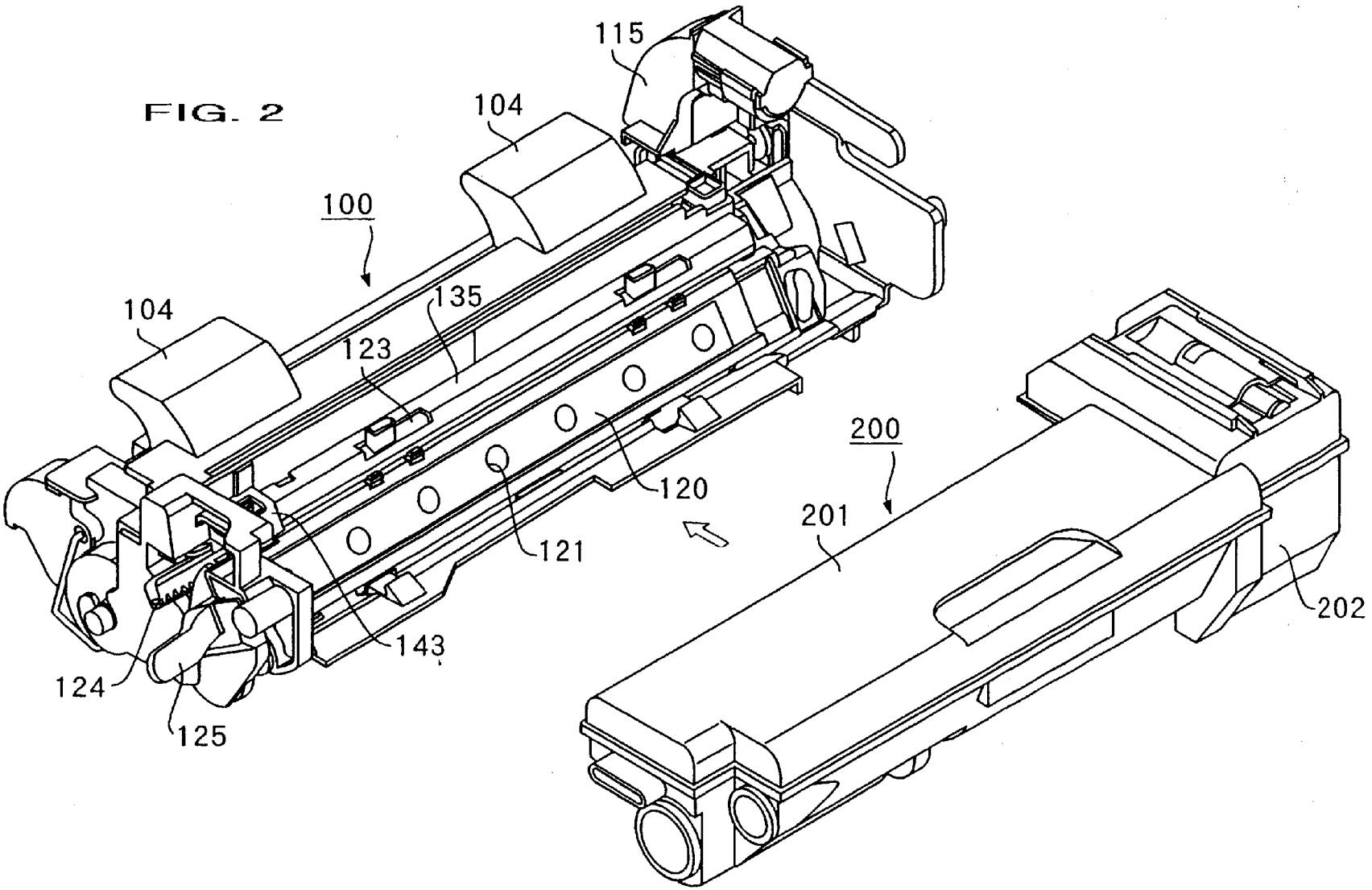
FIG. 2 is a perspective view of an embodiment of the invention with the first and second sub-assemblies separated.

FIG. 2 is a perspective view of the process cartridge with first sub-assembly 100 and second sub-assembly 200 in a mutually separated condition. First sub-assembly 100 is a single structure incorporating an photosensitive drum on which latent image is formed, a developing unit that applies toner to the latent image on the photosensitive drum, and a cleaning unit that removes excess toner adhering to the photosensitive drum. Second sub-assembly 200 is a single structure incorporating toner hopper 201 that supplies toner to the developing unit in the first sub-assembly 100, and waste toner box 202 that stores waste toner collected by the cleaning unit.

Figure 3:
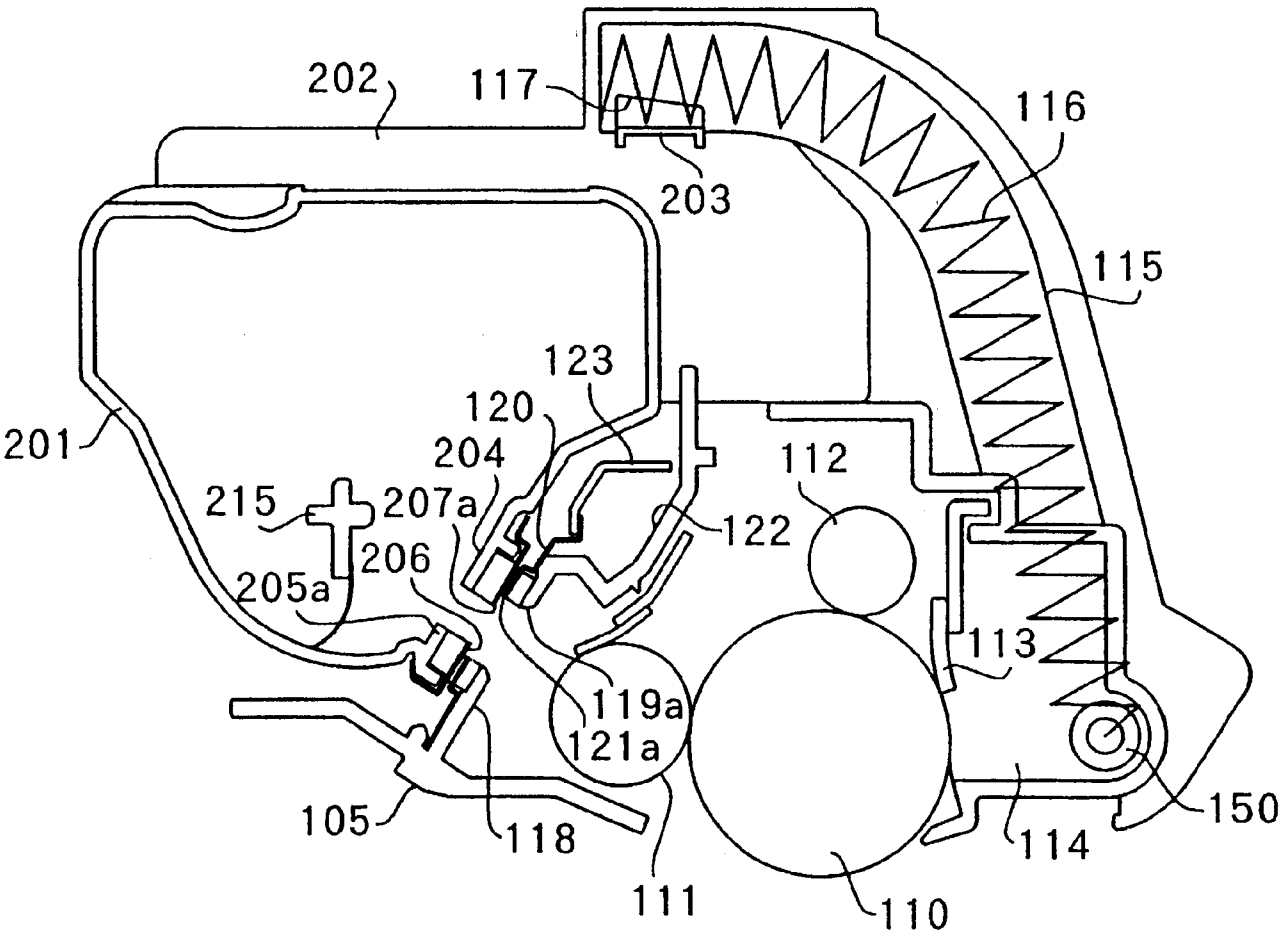
FIG. 3 is a cross sectional view taken from line A–$A^1$ and B–$B^1$ of FIG. 1.

The structure components of the first and second sub-assemblies are explained in reference to FIG. 3.

FIG. 3 is a cross sectional view, taken from lines A–A$^1$ and B–B$^1$ in FIG. 1, that illustrates the structural components of the first and second sub-assemblies.

FIG. 3 shows the positional relationship between photosensitive drum 110, magnetic roller 111, and charging roller 112 to body 105 which is formed as an external wall structure of the developing unit provided in first sub-assembly 100.

Cleaning unit blade 113 is maintained in contact with the surface of photosensitive drum 110 at a position across the photosensitive drum opposite from magnetic roller 111. Waste toner storage space 114, formed as an extension of a part of body 105 adjacent to cleaning unit plate 113, provides a space for temporary storage of waste toner.

The developing unit includes magnetic roller 111, charging roller 112, and their electronic control unit not shown in the drawings. The cleaning unit includes cleaning unit blade 113 and waste toner storage space 114.

Waste toner transport pipe 115 is provided in the first sub-assembly 100 as means of transporting waste toner from storage space 114 to waste toner box 202 in the second sub-assembly 200, and flexible pipe screw 116 is installed within transport pipe 115 as means of moving the waste toner from storage space 114 to the end of pipe 115. Outlet 117 is provided as an opening at the lower side of the extremity of waste toner transport pipe 15. Cap 203 is provided on waste toner box 202 in second sub-assembly 200 and located opposite to outlet 117 of waste toner transport pipe 11. Cap 203 is structured to move and open an interconnecting passage between waste toner transport pipe 115 and waste toner box 202 when first and second sub-assemblies 100 and 200 are joined.

Moreover, a rectangular flat surface region (hereafter termed first joint face 118) formed at the sidewall of body 105 runs along the axial direction of magnetic roller 111. Plural pierced holes 119 are formed in a linear pattern on first joint face 118. The cross sectional view shown in FIG. 3 is taken from a plane passing directly through one of holes 119 which is identified as hole 119*a* in the figure.

FIG. 3 illustrates the relationship between toner hopper 201 in second sub-assembly 200 and the developing unit in first sub-assembly 100. When first and second sub-assembly 100 and 200 are joined, second joint face 204 joined with first joint face 118 of first sub-assembly 100 is provided at the side of toner hopper 201. Holes 205 are provided at second joint face 204 as means of supplying toner from toner hopper 201 to the developing unit in first sub-assembly 100. The cross sectional plane in FIG. 3 runs through orifice 205*a* which is one orifice of orifice group 205 formed on second joint face 204.

First slide shutter 120 is a sealing mechanism slidably installed to first joint face 118 of first sub-assembly 100, and second slide shutter 206 is a sealing mechanism slidably installed to second joint face 204 of second sub-assembly 200.

As shown in FIG. 2, plural holes 121 are formed at first slide shutter 120. Holes 121 of first slide shutter 120 are formed at the same interval as that of holes 119. In addition, as shown in FIG. 3, the diameter of the holes 121 on first slide shutter 120 is identical to that of holes 119 of first joint face 118. FIG. 3 is a cross sectional view through the center of hole 121*a*.

The following will explain the mechanism that operates first slide shutter 120 and second slide shutter 206.

As shown in FIG. 3, in first sub-assembly 100, elongated slide plate 123 is provided, facing predetermined area 122. Slide plate 123 can slide in the same direction of first slide shutter. Slide plate 123 is connected to one part of first slide shutter 120 so as to form a one-piece structure. Thus, slide plate 123 slides together with first slide shutter 120.

As shown in FIG. 2, fixed angle bracket 135 is provided over the upper surface of slide plate 123. Connector plate 143 connected to the part of slide plate 123 is movably provided on fixed angle bracket 135. Connector plate 143 is also equipped with rack gear 124. The teeth on rack gear 124 are aligned so as to move in the same direction as first slide shutter 120 (and slide plate 123). Swing lever 125 is rotaprotrusionly provided, as an hole opening and closing mechanism, to body 105 in proximity to rack gear 124. By installing swing lever 125 to first sub-assembly 100, which has a longer service life than sub-assembly 200, the structure of second sub-assembly 200 can be simplified, thus realizing a more economical design that offers the advantage of reduced replacement cost of second sub-assembly 200.

Figure 4:
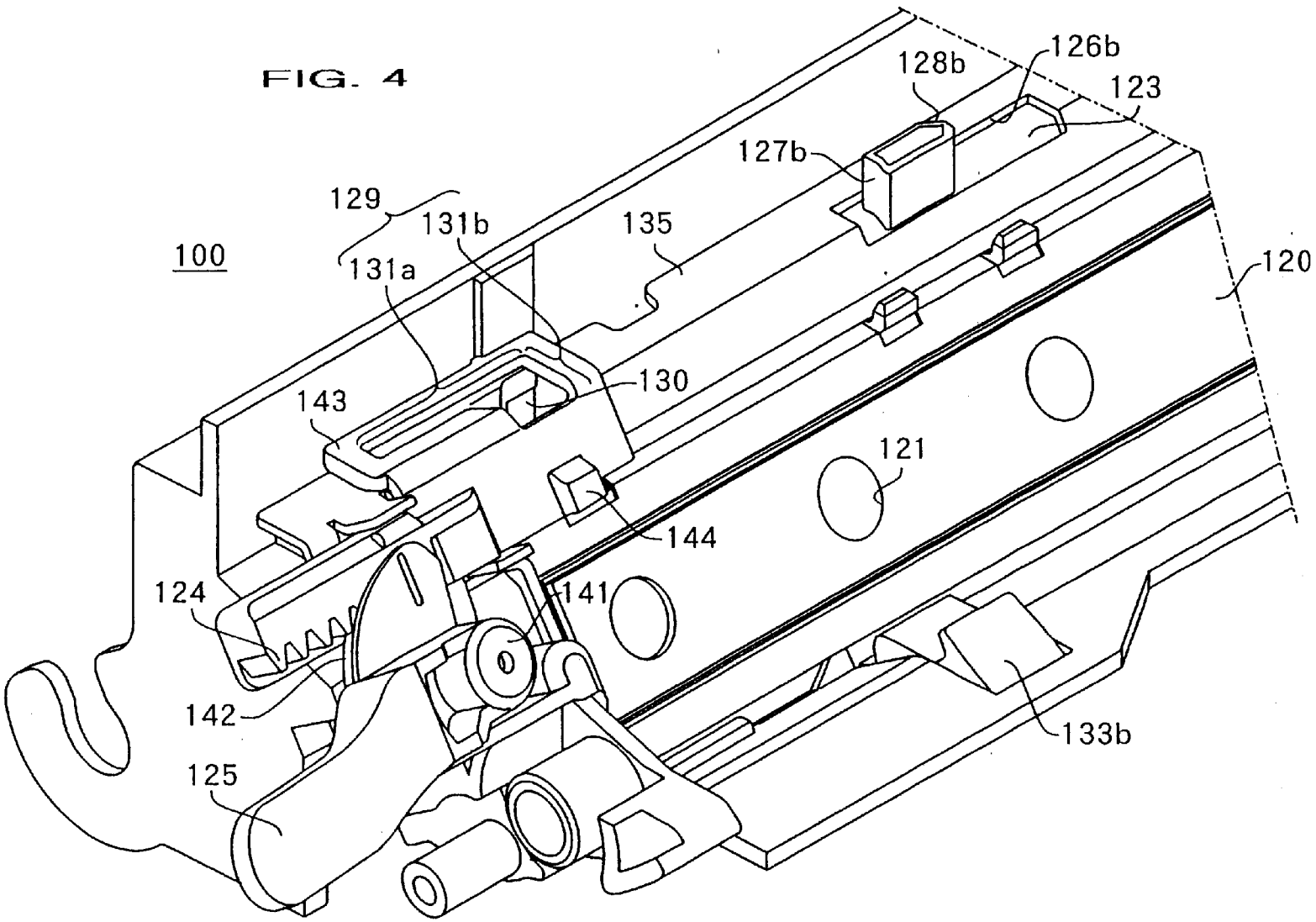
FIG. 4 is detail perspective view of the first sub-assembly with the swing lever is in the first position.

FIG. 4 is an enlarged perspective view of the area adjacent to swing lever 25 of first sub-assembly 100. In order to provide an unobstructed view of the swing lever 125 mechanism, the part of first sub-assembly 100 normally covering the swing lever 125 has been omitted from the drawing. A pinion gear (which cannot be seen in the figure due to its obstruction by cover 142) is formed as an integral component of swing lever shaft 141 of swing lever 125 and meshes with rack gear 124. Thus, upon the movement of swing lever 125, connector plate 143, slide plate 123, and first slide shutter 120 move in the same direction of the movement of swing lever 125.

L-shaped stopper slot 129 is formed within the upper part of connector plate 143. A proximal end of a stopper 130 is fixedly mounted to body 105 (see FIG. 3) and extends upward through stopper slot 129. Stopper slot 129 incorporates first slot 131*a* that runs in the shutter sliding direction, and second slot 131*b* formed as a continuation of one extremity of first slot 131*a* in a direction 90-degrees to that of first slot 131*a*. Stopper 130 is made from a resilient material having properties similar to a plate spring.

Figure 5:
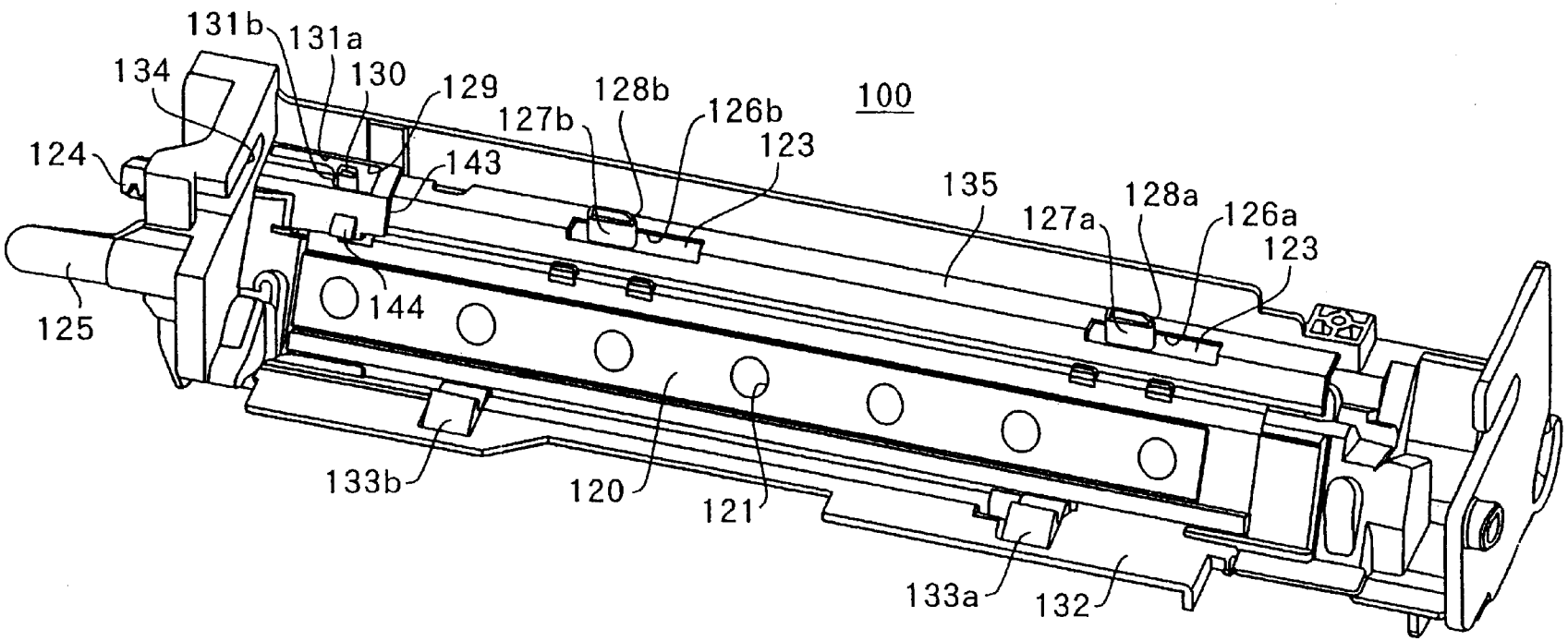
FIG. 5 is a complete perspective view of the first sub-assembly with the swing lever in the first position.

As shown in FIGS. 4 and 5, when swing lever 125 is swung downward (hereafter termed the first position), holes 121 in first slide shutter 120 are out of positions of holes 119 of first joint face 118. Conversely, when swing lever 125 is pulled upward into a vertical position within the first sub-assembly as shown in FIG. 1 (hereafter termed the second position), holes 121 in first slide shutter 120 are in positions of holes 119 of first joint face 118.

When swing lever 125 is in the first position, connector plate 143 is prevented from sliding due to stopper 130 residing within second slot 131*b*. Stopper 130, being made from a resilient material, can be moved out of second slot 131*b* by pushing it back (in FIG. 4) to an inclined attitude within first slot 131*a*, but will return to second slot 131*b* when pressure is released. While movement of connecter plate 143 is prevented by stopper 130 residing in second slot 131*b*, connector plate 143 is able to slide when stopper 130 is moved from second slot 131*b* to first slot 131*a*. In this manner, stopper 130 and L-shaped stopper slot 129 function as a mechanism that prevents first slide shutter 120 from sliding.

First sub-assembly protrusion 144 is provided on the joint face side of connector plate 143 and protrudes toward first slide shutter 120. First sub-assembly protrusion 144 serves as means by which the slide prevention mechanism on second sub-assembly 200 can be released as well as means by which first slide shutter 120 and second slide shutter 206 can be simultaneously slided.

FIG. 5 illustrates first sub-assembly 100 from which the external wall part that forms storage space 114 and photosensitive drum 110 being normally installed in storage space 114 are removed. Slit parts 126*a* and 126*b* are formed within the upper side of fixed angle bracket 135. A pair of toner hopper fixing section 127*a* and 127*b* fixed on slide plate 123 protrudes upward through slit parts 126*a* and 126*b* respectively. Thus toner hopper fixing section 127*a* and 127*b* can move respectively in slit parts 126*a* and 126*b* only within a predetermined distance. Furthermore, toner hopper fixing section 127*a* and 127*b* are formed as hollow pipe-type structures. Tapered parts 128*a* and 128*b* are formed in toner hopper fixing section 127*a* and 127*b*, respectively in a direction opposite to swing lever 125.

Moreover, receiver portion 132 protrudes in the forward direction from the lower surface of the developing unit of first sub-assembly 100. The lower surface of the second joint face of second sub-assembly 200 rides on receiver part 132 when first sub-assembly 100 and second sub-assembly 200 are joined. Moreover, guide groove 134, to which a guide portion of second sub-assembly 200 is inserted, is provided at the sidewall adjacent to the swing lever on first sub-assembly 100.

Figure 6:
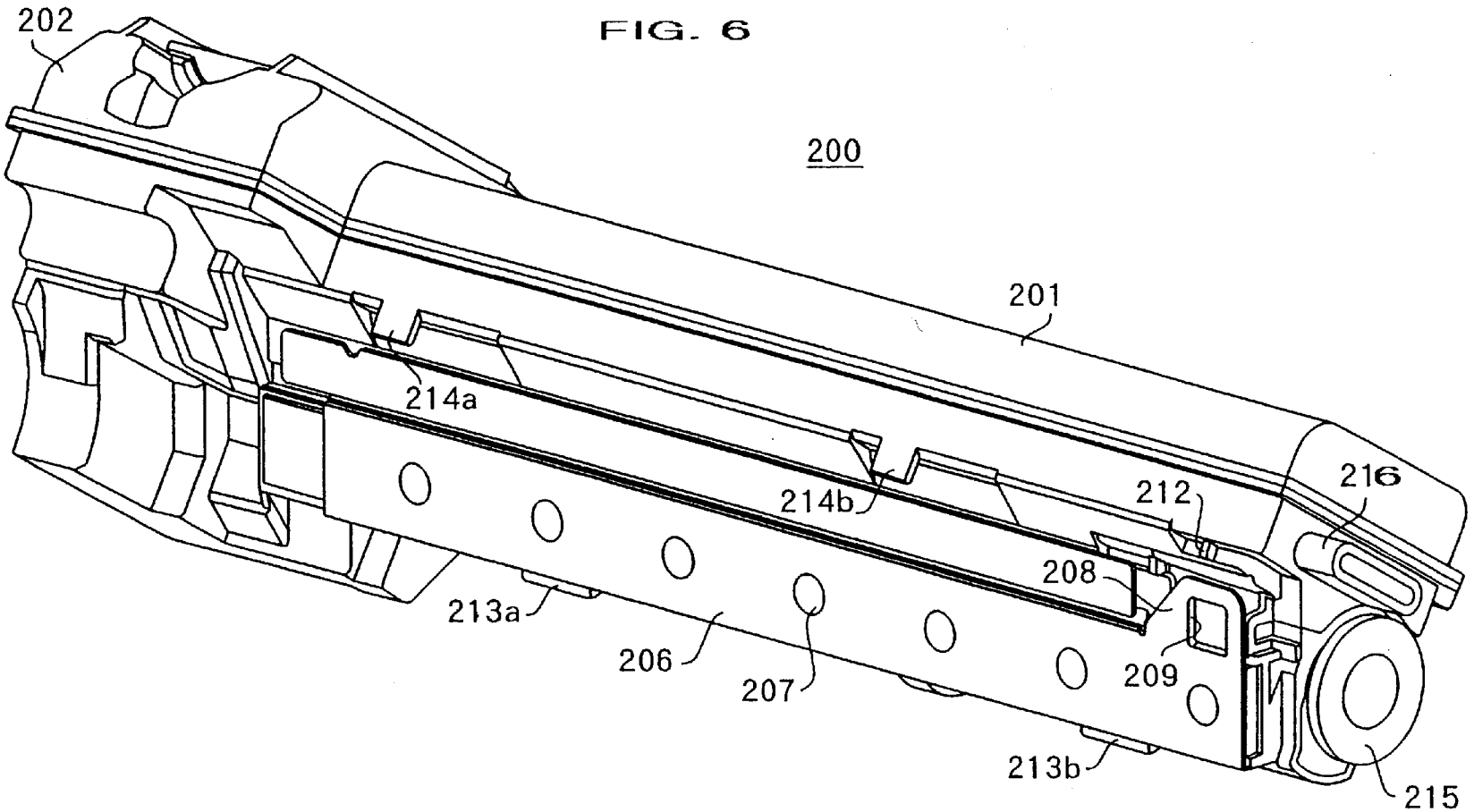
FIG. 6 is a perspective view of the part of the second sub-assembly that relates to first sub-assembly shown in FIG. 5, FIGS. 7*a* and 7*b* are detailed cross sections of the vicinity adjacent to the first and second connecting surfaces.

FIG. 6 is a perspective view illustrating the second sub-assembly 200 that is configured to engage with first sub-assembly 100 as viewed from the second slide shutter 206 side. FIG. 6 shows the condition of second sub-assembly 200 when swing lever 125 of first sub-assembly 100 has been moved to the horizontal position as shown in FIG. 5.

The plural holes 207 are provided in second slide shutter 206. These holes 207 are formed by the same interval as that of holes 205 on second joint face 204. As shown in FIG. 3, holes 207 on second slide shutter 206 and holes 205 on second joint face 204 are formed to the same diameter. FIG. 3 is a cross section in which the cross sectional plane passes through a hole 207*a* of holes 207 on second slide shutter 206.

Figure 7A:
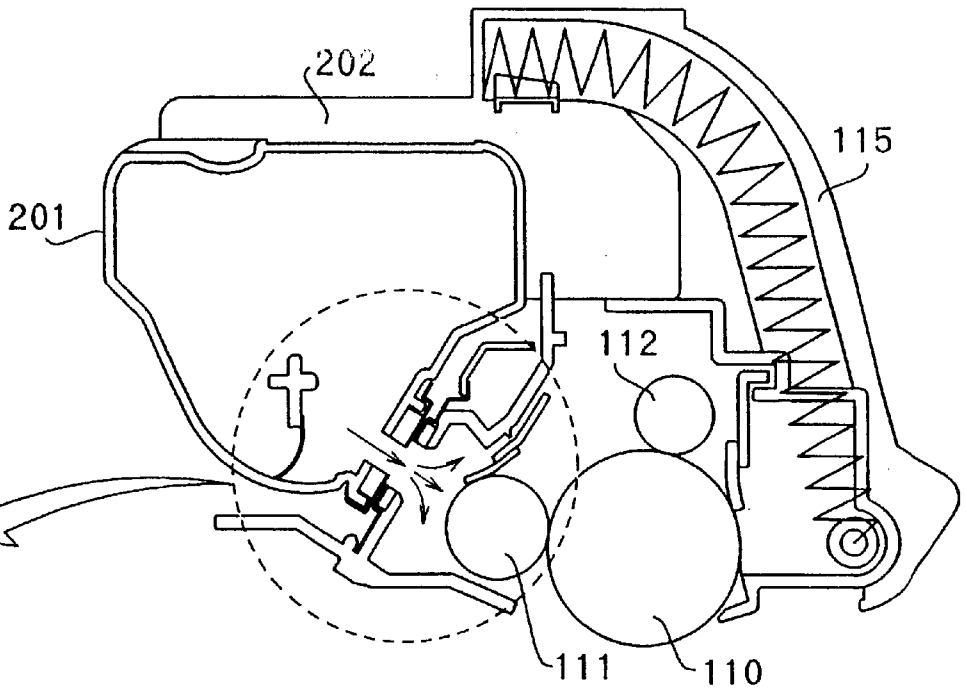
Figure 7B:
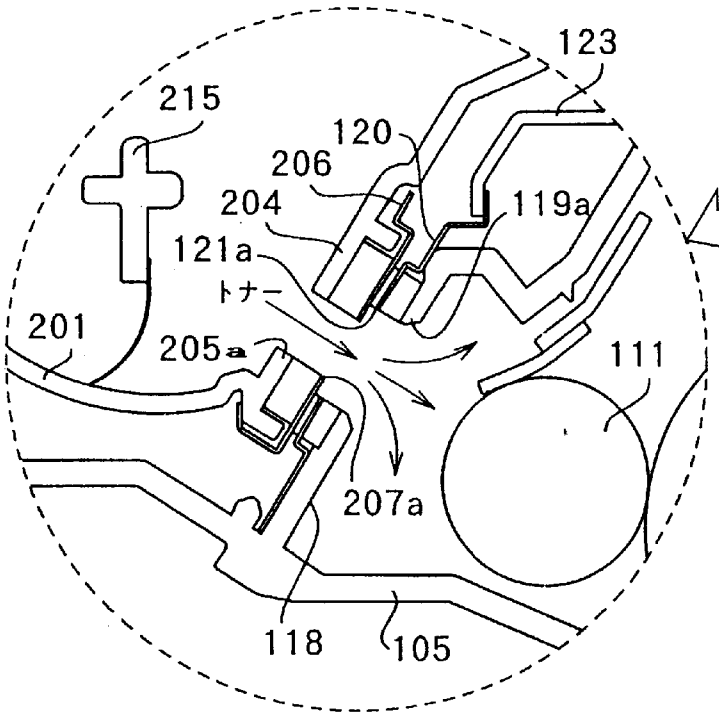

FIG. 7 illustrates the size of the holes formed in first joint face 118 and second joint face 204. FIG. 7 also provides an enlarged view of holes 119*a*, 121*a*, 205*a*, and 207*a* located on first joint face 118 and second joint face 204. As illustrated in the figure, this embodiment demonstrates that the diameters of hole 121*a* on first slide shutter 120 and hole 119*a* on first joint face 118 are larger than those of hole 205*a* on second joint face 204 and hole 207*a* on second slide shutter 206.

This structure enables toner to be scattered around the inside of the developing unit when toner is supplied from toner hopper 201 of second sub-assembly 200 to the developing unit in first sub-assembly 100. Thus, this structure prevents toner from accumulating at specific areas within the developing unit in a way that interferes with the rotation of the developing roller.

The process cartridge may also be structured to esprotrusionlish the respective diameters of holes 205 of second joint face 204, holes 207 of second slide shutter 206, holes 121 of first slide shutter 120, and holes 119 of first joint face 118 with increasingly larger diameters in the above-stated sequence. By sequentially increasing the size of the holes leading from toner hopper 201 to the developing unit, a sequentially increased toner scattering effect is realized as the toner flows from toner hopper 201 to the developing unit.

As illustrated in FIG. 6, flange 208 is formed in second slide shutter 206 at the location corresponding to protrusion 144 of connector plate 143. Further, square-shaped stopper orifice 209 is formed within flange 208. Protrusion 144 of first sub-assembly 100 inserts into stopper orifice 209 when first and second sub-assemblies 100 and 200 are mutually joined.

Figure 8:
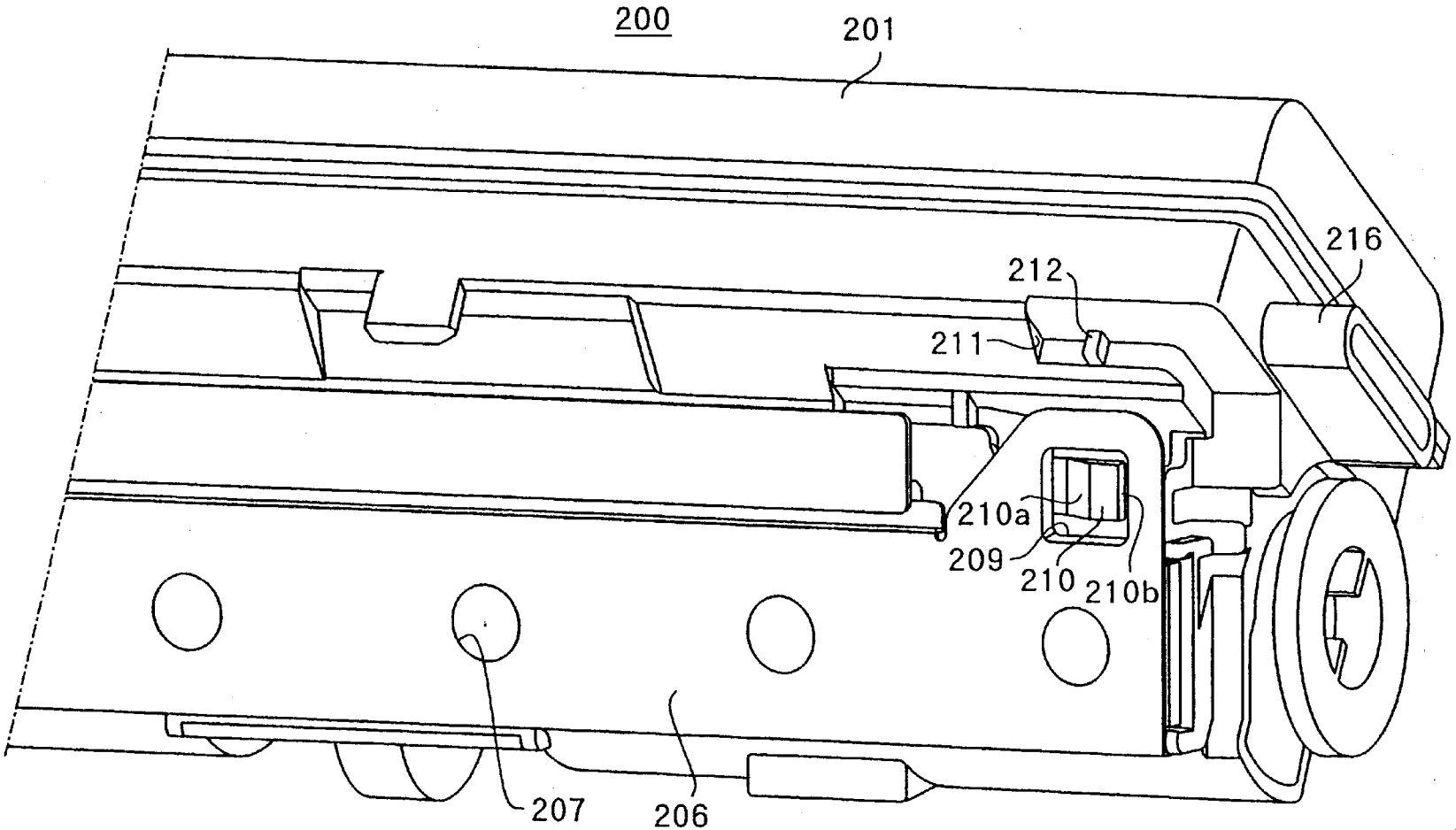
FIG. 8 is a detail perspective view of the part of the second sub-assembly that relates to the first sub-assembly shown in FIG. 4.

FIG. 8 is an enlarged perspective view showing the structures in the vicinity of stopper window 209 on second sub-assembly 200. This view illustrates the position of the shutter when second sub-assembly 200 has been separated from first sub-assembly 100. When second sub-assembly 200 has been separated from first sub-assembly 100, projecting portion 210, which is provided at second joint face 204, extends into stopper window 209 and restricts the movement of second slide shutter 207. Stopper window 209 and projecting portion 210 thus form a mechanism that provides a second slide shutter 207 slide prevention function. In FIG. 8, projecting portion 210 includes tapers 210*a* and 210*b* formed on opposing left and right sides thereon, and is structured as a resilient plate-like member normally attached on the side of second slide shutter 207. Moreover, when projecting portion 210 is pressed back by the insertion of first sub-assembly protrusion 144, sufficient space is secured for projecting portion 210 to withdraw from stopper window 209.

In second sub-assembly 200, the slide prohibition status of second slide shutter 206 is released by insertion of protrusion 144 into stopper window 209. The subsequent movement of slide plate 123 (first slide shutter 120) results in the concurrent movement of second slide shutter 207. When second sub-assembly 200 is separated from first sub-assembly 100, projecting portion 210 inserts and connects to stopper window 209, as shown in FIG. 8, as a result of swing lever 125 being placed in the previously mentioned first position. With slide shutter 206 in this position, holes 205 on second joint face 204 and holes 207 on second slide shutter 206 do not overlap, thus preventing the leakage of toner from toner hopper 201. Moreover, when swing lever 125 is moved to the second position, the holes 207 of second slide shutter 206 coincide with holes 205 of second joint face 204.

Furthermore, space 211 is provided in second sub-assembly 200 to receive connecter plate 143 of first sub-assembly 100. Protrusion 212 is provided at the position of stopper 130 push stopper 130 to the release direction when the first and second sub-assemblies are separated. Protrusion 212 thus functions as means of releasing the slide prohibition mechanism on first sub-assembly 100.

Furthermore, as shown in FIG. 6, toner hopper protrusions 214*a* and 214*b* are provided on second sub-assembly 200 at locations corresponding to toner hopper fixing portions 127*a* and 127*b* on first sub-assembly 100. Further, upper latches 213*a* and 213*b* are provided on second sub-assembly 200 at positions corresponding to latches 133*a* and 133*b* provided on the lower side of first sub-assembly 100. Moreover, guide 216 which engage with guide groove 134 on first sub-assembly 100 is provided on second sub-assembly 200.

Component 215, shown in FIG. 6, is an agitator gear for rotating agitator 215 installed within toner hopper 201.

Figure 9:
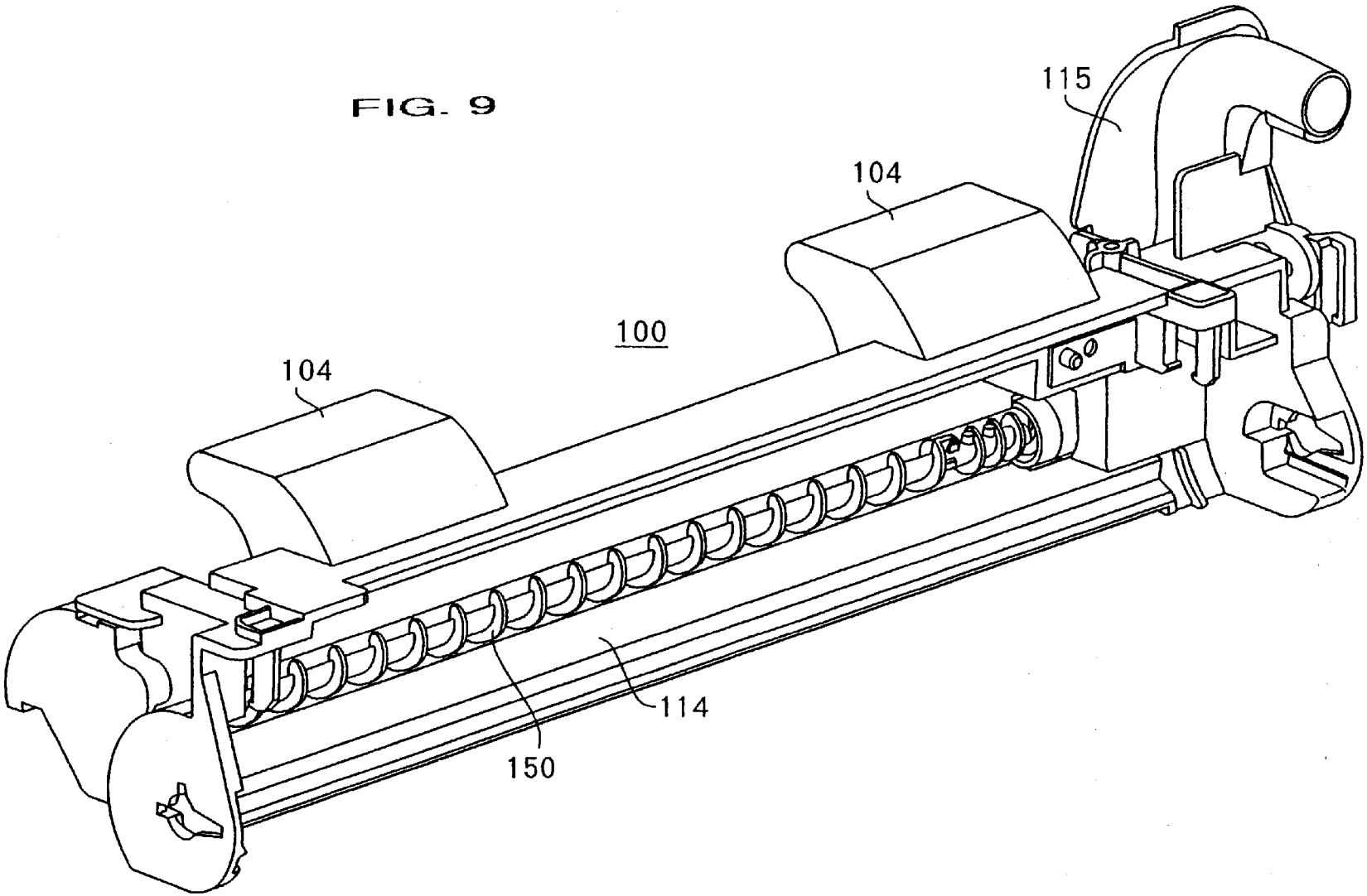
FIG. 9 is a perspective view of the storage area of the first sub-assembly.

FIG. 9 is a perspective view illustrating storage space 114 within first sub-assembly 100. As demonstrated in the drawing, screw 150 is installed within storage space 114 along the entire length of photosensitive drum 110. Screw 150 is rotated by an external gear, and operates so as to carry waste toner in storage space 114 toward waste toner transport pipe 115.

The following discussion explains the operation of the process cartridge, as structured according to the previous descriptions, when first sub-assembly 100 and second sub-assembly 200 are joined.

As shown in FIG. 4, before first and second sub-assemblies 100 and 200 are mutually joined, swing lever 125 is in the first position in which the lever extends horizontally outward from first sub-assembly 100. In this first position, connector plate 143, slide plate 123, and first slide shutter 120 have moved to a position closer to the swing lever 125. In this position, stopper 130 positions within second groove 131*b* of stopper L-shaped groove 129. Therefore, even though pressure is applied to connecting plate 143 in the release direction of the shutter (to the left as shown in FIG. 4), the movement of stopper 130 is prevented because of connecting to the edge of second groove 131*b*.

This structure, in which stopper 130 is in contact with second groove 131*b* when first sub-assembly 100 is separated from second sub-assembly 200, prevents swing lever 125 from moving from the first position to the second position. As a result, swing lever 125 cannot be rotated out of the first position, the position in which the swing lever is extending outward from first sub-assembly 100, when first sub-assembly 100 and second sub-assembly 200 are not joined. Thus, when first sub-assembly 100 is independently installed into the process cartridge installation space without second sub-assembly 200, it can not be installed due to swing lever 125. The extended position of swing lever 125 interferes with the insertion of first sub-assembly 100 only into the process cartridge installation space provided in the recording apparatus. This mechanism prevents the insertion of first sub-assembly 100 into the process cartridge installation space when not joined to sub-assembly 200, that is, it prevents the insertion of the process cartridge in a non-functioning condition.

When first sub-assembly 100 is separated from second sub-assembly 200, slide plate 123 and first slide shutter 120, which are integral to connector plate 143, cannot move as a result of stopper 130 being in contact with the end of second groove 131*b*. Accordingly, when first sub-assembly 100 and second sub-assembly 200 are separated, leakage of toner from the developing unit in first sub-assembly 100 is effectively prevented even if the user mistakenly attempts to move swing lever 125.

When second sub-assembly 200 is separated from first sub-assembly 100, projecting portion 210 engages with stopper window 209 in second slide shutter 206. At this time, holes 205 on second joint face 204 are displaced holes 207 on second slide shutter 206, thus, are covered by second slide shutter 206.

Accordingly, when second sub-assembly 200 is separated from first sub-assembly 100, movement of second slide shutter 206 is prevented by projecting portion 210 being inserted to stopper window 209. Therefore, this mechanism is able to prevent leakage of toner from toner hopper 201 in second sub-assembly 200 even if the user mistakenly attempts to move second slide shutter 206.

The following discussion concerns the mutual joining of first sub-assembly 100 and second sub-assembly 200. To mutually connect the two sub-assemblies, guide 214 of second sub-assembly 200 (as shown in FIG. 6) is inserted into guide channel 134 of first sub-assembly 100 (as shown in FIG. 5) so that guide 214 reaches completely down to the bottom of guide groove 134.

By joining guide 214 of second sub-assembly 200 to guide groove 134 on first sub-assembly 100, the position of protrusion 212 on second sub-assembly 200 is determined so as to be in the same position as that of stopper 130 on first sub-assembly 200. Further, the position of stopper window 209 (as well as projecting portion 210) is determined so as to be in the same position as that of protrusion 144 of first sub-assembly 200. And upper latches 213*a* and 213*b* on the upper side of second sub-assembly 200 are determined so as to be in the same positions as those of latches 133*a* and 133*b* on the lower surface of first sub-assembly 100.

During the process in which guide 214 on second sub-assembly 200 is inserted completely into guide groove 134 on first sub-assembly 100, protrusion 212 presses against stopper 130 to the direction that releases the status for prohibiting slide. When guide 214 of second sub-assembly 200 is inserted completely into the bottom of guide groove 134, stopper 130 is pushed out from second groove 131*b* (slide prevention position) to first groove 131*a* (slide prevention release position). This mechanism, which is activated through the operation of stopper 130, allows connector plate 143, slide plate 123, and first slide shutter 120 to become freely movable.

Also, the slide prevention release operation of second slide shutter 206 is simultaneously performed, during the operation in which second sub-assembly guide 214 is being inserted completely into guide groove 134. In other words, first sub-assembly protrusion 144 pushes projecting portion 210 from stopper window 209. At the point where second sub-assembly guide 214 is completely inserted into the bottom of guide groove 134, projecting portion 210 has been pushed out of stopper window 209. At the same time, protrusion 144 engages with stopper window 209.

This removal10 allows second slide shutter 206, which had been locked in an immovable condition, to be moved.

Also, because first sub-assembly protrusion 144 inserts and joins to second sub-assembly stopper window 209, first slide shutter 120 and second slide shutter 206 are connected to form a single movable shutter assembly.

The mechanism through which first and second sub-assemblies 100 and 200 are joined eliminates the operation to release the slide prevention mechanism, eliminates the manual operation which would be required to operate that separate device, and thus simplifies the operation through which first sub-assembly 100 and second sub-assembly 200 are mutually connected.

Furthermore, when first and second sub-assemblies 100 and 200 are joined, swing lever 125 result in allowing movement to the second position. Thus, the only operation to connect first sub-assembly 100 and second sub-assembly 200 can prevent the independent installation of first sub-assembly 100 or second sub-assembly 200 into the recording apparatus. And it can be simplified to join first sub-assembly 100 and second sub-assemblies 200.

The insertion of second sub-assembly guide 214 completely into the bottom of guide groove 134 of first sub-assembly 100 also results in latches 133*a* and 133*b* located on the lower side of first sub-assembly 100 connecting to latches 213*a* and 213*b* located on the upper side of second sub-assembly 200.

The connections formed between first sub-assembly 100 lower latches 133*a* and 133*b* and second sub-assembly 200 upper latches 213*a* and 213*b* provide a locking mechanism that prevents the separation of the joined sub-assemblies even if pressure is applied in a direction 90 degrees to the shutter sliding direction.

Figure 10:
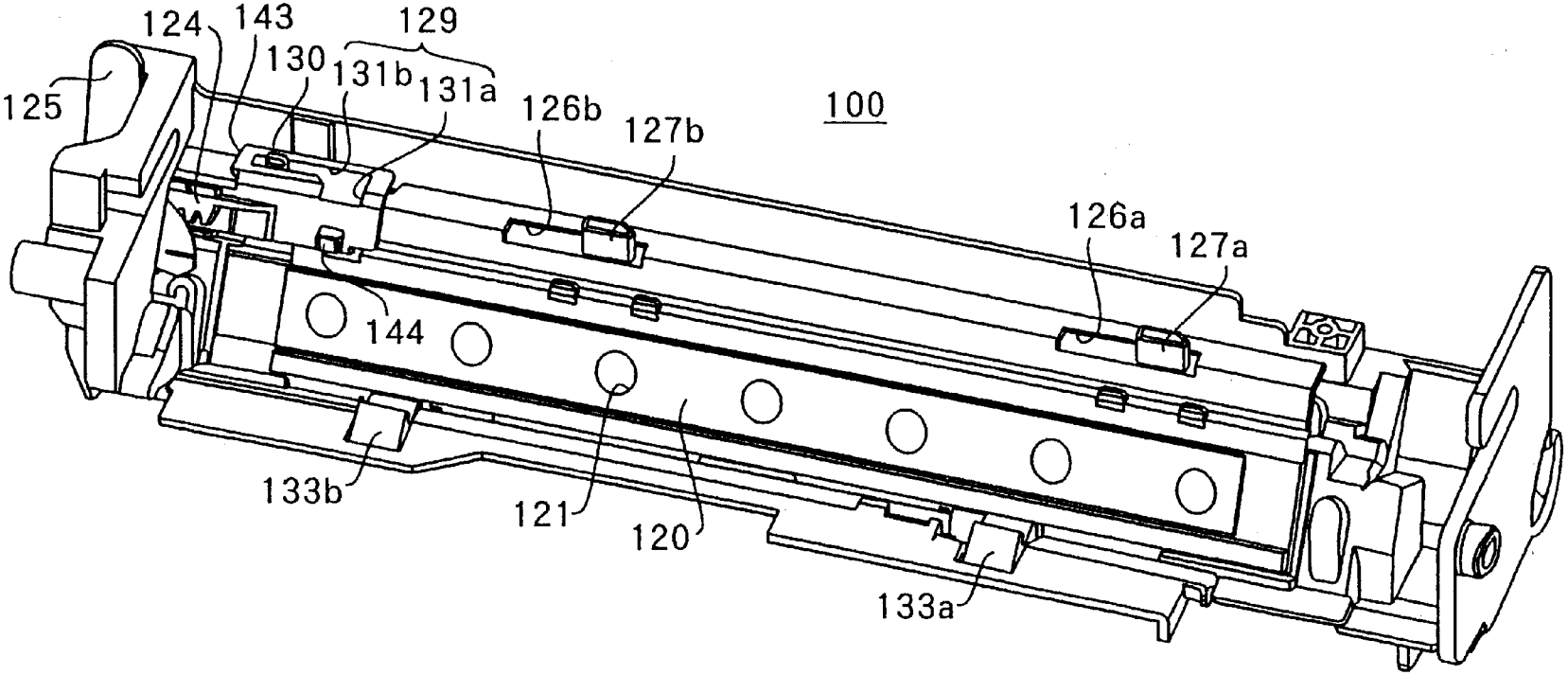
FIG. 10 is a complete perspective view of the first sub-assembly in which the swing lever is in a second position.

The following describes the operation that transpires when swing lever 125 is manually moved from the first to the second position. When swing lever 125 is rotated to the second position, the pinion gear, which is installed to pinion shaft 141 of swing lever 125, moves rack gear 124 to the right as viewed in FIG. 5. By this action, connector plate 143 connected to rack gear 124 moves to the right. As a result, stopper 130 moves in the relative opposite direction within first groove 131*a*, that is, in the left hand direction as viewed in FIG. 5. FIG. 10 illustrates first sub-assembly 100 with swing lever 125 rotated to the second position and stopper 130 now located at the left extremity of first groove 131*a*.

Furthermore, because slide plate 123 attached connector plate 143 move in the same direction, toner hopper connecting portions 127*a* and 127*b*, which are fixedly attached to slide plate 123, also move in the same direction.

When second sub-assembly guide 214 is inserted into first sub-assembly guide groove 134 to connect first and second sub-assemblies 100 and 200, toner hopper protrusions 214*a* and 214*b* on second sub-assembly 200 move past the right sides of their respective toner hopper connecting portions 127*a* and 127*b* on first sub-assembly 100. Then, toner hopper protrusions 214*a* and 214*b* stop at a position behind toner hopper connecting portions 127*a* and 127*b*.

Subsequently, when swing lever 125 is moved from the first to the second position, toner hopper connecting portions 127*a* and 127*b* slide to the right direction. And, toner hopper protrusions 214*a* and 214*b* connect to tapered surfaces 128*a* and 128*b* respectively, to form a pressurized overlapping connection there between. As a result, the lower side of second sub-assembly 200 is locked through the connection of latches 213*a* and 213*b* to latches 133*a* and 133*b*, and the upper side of second sub-assembly 200 is strongly fixed through toner hopper connecting portions 127*a* and 127*b* and toner hopper protrusions 214*a* and 214*b*.

When swing lever 125 is rotated from the first position to the second position, first slide shutter 120 slides to the right, as viewed in FIG. 5, through its connection to connector plate 142 and slide plate 123. FIG. 10 illustrates first slide shutter 120 as having moved to the released position. The movement of first slide shutter 120 to the released position brings holes 121 on first slide shutter 120, as shown in FIGS. 3 and 7, into alignment with holes 119 on joint face 118. As a result, toner can flow to the developing unit through holes 119 and 121.

Figure 11:
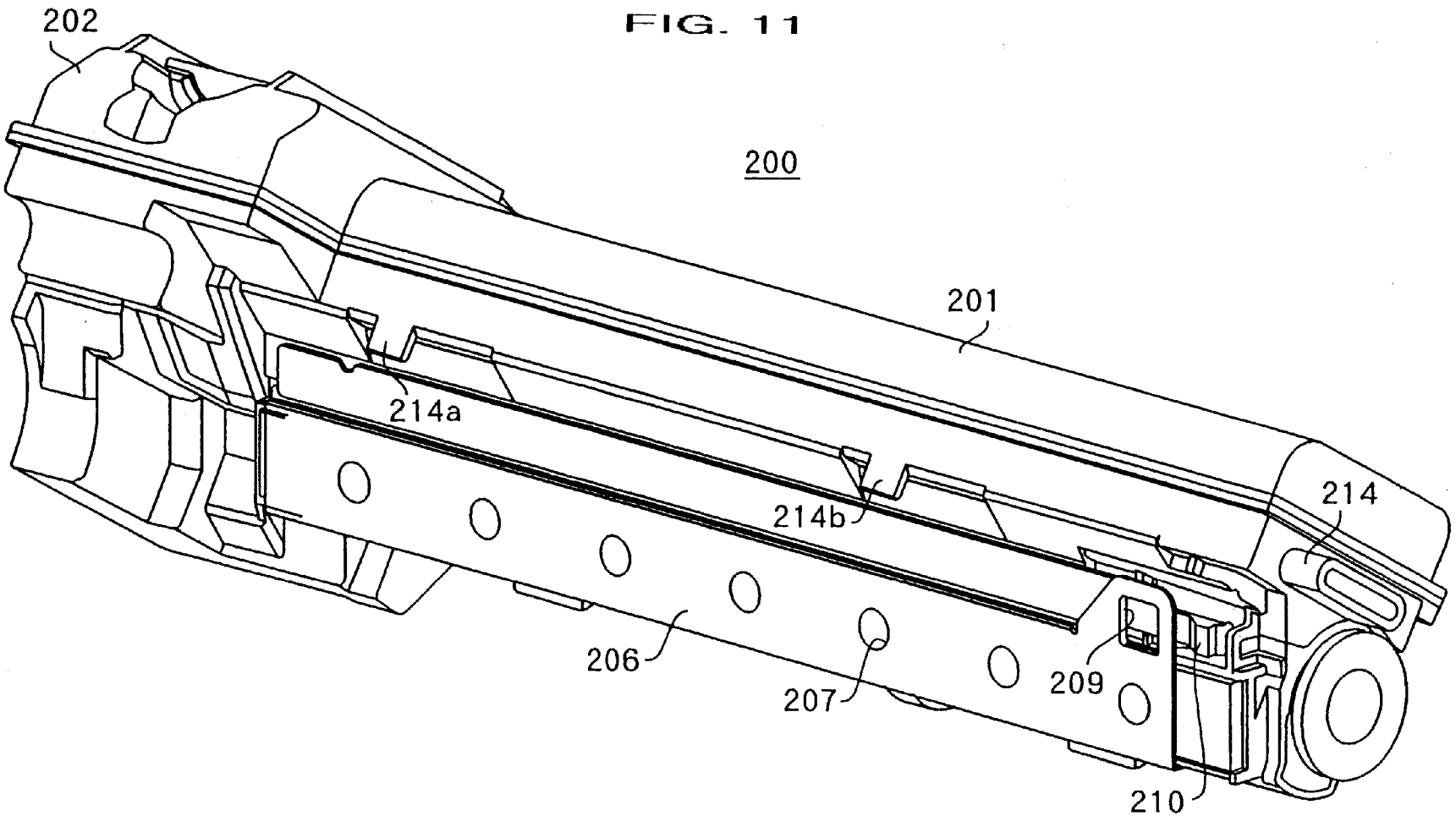
FIG. 11 is a full perspective view of the second sub-assembly in which the swing lever is in the first position.

To further explain the structure of second sub-assembly 200, because first sub-assembly protrusion 144 on connector plate 143 has inserted and connected to window 209 on second slide shutter 206, the movement of connector plate 143, driven by the rotation of swing lever 125, is transferred to second slide shutter 206 in the same direction and for the same distance. FIG. 11 illustrates second sub-assembly 200 in a condition in which second slide shutter 206 has moved to its released position. Second slide shutter 206 moves toward the left side of second joint face 204.

When second slide shutter 206 moves to its released position, holes 207 formed thereon moves into alignment with holes 205 on second joint face 204. Thus, toner can flow from toner hopper 201 to the developing unit through holes 205 and 207.

Therefore, the operation of swing lever 125 is sufficient to simultaneously align holes 119 of first sub-assembly 100, holes 121 of first slide shutter 120, holes 204 of second sub-assembly 200, and holes 207 on second slide shutter 206. Thus, this structure is able to prevent toner leakage while supplying toner from toner hopper 201 to the developing unit, and is easily assembled through a simple joining operation of first sub-assembly 100 and second sub-assembly 200.

Moreover, swing lever 125 is operated from an external location as means of opening and closing holes 119 and 205 on the external walls of first and second sub-assemblies 100 and 200, thus eliminating the need for the operator to physically touch second slide shutters 120 and 206, and preventing the operator from becoming soiled by the toner. Furthermore, because the operation of swing lever 125 is all that is required to open and close holes 119 and 205 on the external walls of the respective first and second sub-assemblies, the operator is able to easily open or close the holes on the external walls of first and second sub-assemblies 100 and 200.

The operation by which the process cartridge is separated into first sub-assembly 100 and second sub assembly 200 is the reverse procedure by which they were joined.

When applied to the jumping development type of recording process which produces a considerable amount of waste toner, this embodiment structures toner hopper 201 and waste toner box 202 as components included in second sub-assembly 200 which can be replaced separately from other components of the process cartridge that relate to the development processes. As a result, when waste toner box 202 becomes full, only second sub-assembly 200 need be replaced, thus simplifying the process cartridge replacement operation and reducing operating costs by allowing other development process components that have a longer service life to remain in operation without unnecessary replacement.

Furthermore, because toner hopper 201 and waste toner box 202 are low cost components with a short service life, and because they are combined into a single structure that can be removed and replaced separately from other higher cost development unit components, the process cartridge can be designed as a module-type structure, comprised of first and second sub-assemblies 100 and 200, that takes into consideration the cost of the various development process components. This type of process cartridge is thus able to lower the cost of component replacement while providing a simplified replacement procedure.

In the previously described embodiment, swing lever 125 is installed to first sub-assembly 100 as means of opening and closing the orifice groups because first assembly 100 has a longer service life than that of second sub-assembly 200. In a case where cost is not the main consideration, swing lever 125 may be incorporated into second sub-assembly 200 as means of moving first slide shutter 120 through the movement of second side shutter 206.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein, rather, the present invention extends to all functionally equivalent structures, methods and uses, such as are within the scope of the appended claims.

The present invention is not limited to the above described embodiments, and various variations and modifications may be possible without departing from the scope of the present invention.

This application is based on the Japanese Patent Application No. 2001-253406 filed on Aug. 23, 2001, entire content of which is expressly incorporated by reference herein.

What is claimed is:

1. A process cartridge attachable to a recording apparatus, the process cartridge comprising:

a first unit that comprises a photosensitive member, a developing unit that forms an image on the photosensitive member, and a cleaning unit that collects residual toner from the photosensitive member; and a second unit that comprises a toner hopper unit that supplies toner on the photosensitive member, and a waste toner box that stores the collected residual toner, the second unit being separable from the first unit, wherein the developing unit engages with the toner hopper unit so as to engage the first unit with the second unit.

2. The process cartridge according to claim 1, further comprising:

a first shutter provided in the first unit, the first shutter slidably covering a first joint surface of the developing unit, the first joint surface including a plurality of first openings, the first shutter including a plurality of second openings respectively corresponding to the plurality of first openings in the first surface;

a second shutter provided in the second unit, the second shutter slidably covering a second joint surface on the toner hopper unit, the second joint surface including a plurality of third openings, the second shutter including a plurality of fourth openings respectively corresponding to the plurality of third openings in the second joint surface; and an open/close mechanism that slides the first and second shutters when the first unit engages with the second unit so that the plurality of first openings, the plurality of second openings, the plurality of third openings and the plurality of fourth openings are aligned with one another to form a path supplying the toner from the toner hopper unit to the developing unit.

3. The process cartridge according to claim 2, further comprising a first slide locking mechanism that prohibits sliding movement of the first shutter when the first unit is separated from the second unit, and a second slide locking mechanism that prohibits sliding movement of the second shutter, when the first unit is separated from the second unit.

4. The process cartridge according to claim 3, wherein, when the first unit and the second unit engage with each other, the first and second locking mechanism respectively release the prohibition of the sliding movements of the first and second slide shutters.

5. The process cartridge according to claim 2, wherein, when the first unit and the second unit engage with each other, the open/close mechanism slides the first shutter and the second shutter together and simultaneously.

6. The process cartridge according to claim 2, wherein the open/close mechanism is provided on at least one of the first unit and the second unit, and is rotatable between a first state and a second state, wherein the open/close mechanism extends outwardly from the at least one of the first and second units in the first state, and is retracted into the at least one of the first and the second units in the second state, and wherein the plurality of first openings and the plurality of third openings are respectively shifted from the plurality of second openings and the plurality of fourth openings in the first state, and the plurality of first, second, third and fourth openings are aligned with each other in the second state.

7. The process cartridge according to claim 6, further comprising a rotation lock mechanism provided on at least one of the first unit and the second unit, the rotation lock mechanism prohibiting the open/close mechanism from rotating when the first unit is separated from the second unit.

8. The process cartridge according to claim 7, wherein the rotation lock mechanism releases the prohibition of rotation of the open/close mechanism, when the first unit and the second unit engage with each other.

9. The process cartridge according to claim 6, wherein the open/close mechanism is provided on the first unit.

10. The process cartridge according to claim 2, wherein the open/close mechanism is provided on at least one of the first unit and the second unit, and is rotatable between a first state and a second state, wherein the open/close mechanism extends outwardly from the at least one of the first and second units in the first state, and is retracted into the at least one of the first and the second units in the second state, wherein, in the first state, the first shutter slides to cover the plurality of first openings simultaneously with separation of the first unit and the second unit, and wherein, in the second state, the first shutter slides to align the plurality of first openings with the plurality of the second openings simultaneously with engagement between the first unit and the second unit.

11. The process cartridge according to claim 2, wherein a diameter of each of the plurality of first openings and a diameter of each of the plurality of second openings are larger than a diameter of each of the plurality of third openings and a diameter of each of the plurality of fourth openings.

12. The process cartridge according to claim 2, wherein a diameter of each of the plurality of third openings in the second joint surface, a diameter of each of the plurality of fourth openings in the second shutter, a diameter of each of the plurality of second openings in the first shutter, and a diameter of each of the plurality of first openings in the first joint surface are larger in this order.

13. A recording apparatus in combination with a process cartridge, comprising:

a recorder configured to record an image on a recording medium by utilizing the process cartridge; and the process cartridge comprising:

a first unit that comprises a photosensitive member, a developing unit that forms an image on the photosensitive member, and a cleaning unit that collects residual toner from the photosensitive member; and a second unit that comprises a toner hopper unit that supplies toner on the photosensitive member, and a waste toner box that stores the collected residual toner, the second unit being separable from the first unit, wherein the developing unit engages with the toner hopper unit so as to engage the first unit with the second unit.

14. The recording apparatus according to claim 13, wherein the process cartridge further comprises:

a first shutter provided in the first unit, the first shutter slidably covering a first joint surface of the developing unit, the first joint surface including a plurality of first openings, the first shutter including a plurality of second openings respectively corresponding to the plurality of first openings in the first surface;

a second shutter provided in the second unit, the second shutter slidably covering a second joint surface on the toner hopper unit, the second joint surface including a plurality of third openings, the second shutter including a plurality of fourth openings respectively corresponding to the plurality of third openings in the second joint surface; and an open/close mechanism that slides the first and second shutters when the first unit engages with the second unit so that the plurality of first openings, the plurality of second openings, the plurality of third openings and the plurality of fourth openings are aligned with one another to form a path supplying the toner from the toner hopper unit to the developing unit.

15. The recording apparatus combination according to claim 14, the process cartridge further comprising a first slide locking mechanism that prohibits sliding movement of the first shutter when the first unit is separated from the second unit, and a second slide locking mechanism that prohibits sliding movement of the second shutter, when the first unit is separated from the second unit.

16. The recording apparatus combination according to claim 15, wherein, when the first unit and the second unit engage with each other, the first and second locking mechanism respectively release the prohibition of the sliding movements of the first and second slide shutters.

17. The recording apparatus combination according to claim 14, wherein, when the first unit and the second unit engage with each other, the open/close mechanism slides the first shutter and the second shutter together and simultaneously.

18. The recording apparatus combination according to claim 14, wherein the open/close mechanism is provided on at least one of the first unit and the second unit, and is rotatable between a first state and a second state, wherein the open/close mechanism extends outwardly from the at least one of the first and second units in the first state, and is retracted into the at least one of the first and the second units in the second state, and wherein the plurality of first openings and the plurality of third openings are respectively shifted from the plurality of second openings and the plurality of fourth openings in the first state, and the plurality of first, second, third and fourth openings are aligned with each other in the second state.

19. The recording apparatus combination according to claim 18, the process cartridge further comprising a rotation lock mechanism provided on at least one of the first unit and the second unit, the rotation lock mechanism prohibiting the open/close mechanism from rotating when the first unit is separated from the second unit.

20. The recording apparatus combination according to claim 19, wherein the rotation lock mechanism releases the prohibition of rotation of the open/close mechanism, when the first unit and the second unit engage with each other.

21. A process cartridge attachable to a recording apparatus, the process cartridge comprising:

a first unit that comprises a photosensitive member, and a developing unit that forms an image on the photosensitive member; and a second unit that comprises a toner hopper unit that supplies toner on the photosensitive member, the second unit being separable from the first unit, wherein the developing unit engages with the toner hopper unit so as to engage the first unit with the second unit.

* * * * *